US012178376B2

(12) United States Patent
Ramos-Valcarce Morcillo

(10) Patent No.: US 12,178,376 B2
(45) Date of Patent: Dec. 31, 2024

(54) SELF-WRINGING MOP SYSTEM

(71) Applicant: INICIATIVAS VIVAL S.L, Cáceres (ES)

(72) Inventor: Miguel Angel Ramos-Valcarce Morcillo, Plasencia (ES)

( * ) Notice: Subject to any disclaimer, the term of this patent is extended or adjusted under 35 U.S.C. 154(b) by 242 days.

(21) Appl. No.: 17/775,808

(22) PCT Filed: Nov. 11, 2020

(86) PCT No.: PCT/ES2020/070698
§ 371 (c)(1),
(2) Date: May 10, 2022

(87) PCT Pub. No.: WO2021/094637
PCT Pub. Date: May 20, 2021

(65) Prior Publication Data

US 2023/0035185 A1 Feb. 2, 2023

(30) Foreign Application Priority Data

Nov. 12, 2019 (ES) ..... ES201900169

(51) Int. Cl.
*A47L 13/58* (2006.01)
*A47L 13/14* (2006.01)

(52) U.S. Cl.
CPC ..... *A47L 13/58* (2013.01); *A47L 13/14* (2013.01)

(58) Field of Classification Search
CPC ..... A47L 13/14; A47L 13/59; A47L 13/58; A47L 13/258; A47L 13/253; A47L 13/20
USPC ..... 15/26, 119.1
See application file for complete search history.

(56) References Cited

U.S. PATENT DOCUMENTS

2011/0209297 A1* 9/2011 Ramos Valcarce Morcillo ..... A47L 13/58 15/119.1

FOREIGN PATENT DOCUMENTS

WO WO-2010049554 A1 * 5/2010 ..... A47L 13/14

OTHER PUBLICATIONS

Translation of Wo2010049554 (Year: 2010).*

* cited by examiner

*Primary Examiner* — Tom Rodgers

(57) ABSTRACT

The invention discloses a self-wringing mop system comprising a main body (1), a head (6) couplable to the main body (1), and a bucket (7) having a particular wringer (71). The interaction between the elements making up this system reduces the effort a user needs to make to wring the mop. The invention is also directed to each of the individual elements, in particular the main body (1), the head (6) and the bucket (7).

23 Claims, 7 Drawing Sheets

A-A'

SELF-WRINGING MOP SYSTEM

OBJECT OF THE INVENTION

The present invention belongs to the field of utensils used for cleaning floors.

The object of the present invention is a new mop system having a self-wringing mechanism designed to minimise the effort of the user.

PRIOR ART

The mop nowadays still is the most used utensil for cleaning floors. As generally known, a conventional mop is mainly formed by a pole having lower end with a head having a plurality of strips made of an absorbent textile material. During use, the user holds the mop by the pole and drags the textile strips of the head against the floor. Thereafter, the head is introduced into a bucket filled with water and soap and then wringed using a wringer attached to the bucket This type of universally known mops are disadvantageous in that the method for wringing the mop is inconvenient. Indeed, to wring the head of the mop it is necessary to introduce the head into the wringer and, thereafter, apply a considerable force for compressing the absorbent strips attached to the head and, thereby, expel the water therefrom.

To solve this problem, a number of wringing systems and mechanisms have been designed that, in most cases, are focused on the wringer design. As an example, the following can be mentioned.

Spanish patent ES2380715 discloses a mop formed by a plurality of strips configured to compress the head of the mop when the user presses vertically downwards against the wringer.

Spanish utility model U7801949 discloses another wringer basically formed by a press mounted on a rolling structure also allowing for compressing the head of the mop.

Spanish patent ES2303391 discloses a similar wringer to that disclosed in the present document, but with an important difference in the manner in which the cams open. This feature will be disclosed in further detail in the present document.

In short, none of these wringer systems duly solves the problem, and therefore there still exists in the art the need for an improved wringer system.

DESCRIPTION OF THE INVENTION

The inventor of the present application provides a solution to this problem thanks to a new mop design greatly improving the wringing procedure. Generally speaking, the new wringing system is based on a longitudinal displacement of the head of the mop in relation with the pole thereby making it easier for the user to compress the set of strips fixed to the head against the surface of the wringer. Simultaneously with the longitudinal displacement of the mop head, the end of the pole has locking elements preventing the mop head from exiting the wringer. This system, whose particular features will be clearly disclosed in this document, reduces the effort needed to wring the mop.

In this document, references to the directions such as "up", "superior" or the like, as well as "down", "inferior", or the like, must be interpreted in connection to the natural position of the self-wringing mop of the invention. Therefore, the lower end of the self-wringing mop is that where the head is located, and the upper end of the self-wringing mop is that where the user holds it.

The present invention is directed to a self-wringing mop system comprising mainly three elements: a main self-wringing mop body, a self-wringing mop head, and a bucket having a wringer with particular characteristics. Next, each of these elements is disclosed in further detail.

a) Main body

The main body of the mop of the invention is mainly formed by the following parts:

Pole: It is a pole having an inner duct.

In principle, the inner duct is a single cylindrical duct running along the hole pole essentially from the grabbing end to the lower end.

Jacket: It is a cylindrical jacket slidingly provided around the pole and connected to a minor plunger sliding in a watertight manner along the inner duct of said pole. Therefore, when the user causes the cylindrical jacket to longitudinally slide along the pole, the minor plunger moves longitudinally along the inner duct of the pole. To allow connection between the jacket, provided outside the pole, and the plunger, provided inside the pole, the pole has a longitudinal groove allowing for a connection element between jacket and minor plunger to pass through.

Additionally, the main body of the self-wringing mop can comprise a latch (54) allowing for the user to selectively lock the cylindrical jacket in the retracted position. This allows for overriding the self-wringing mechanism disclosed in the present invention depending on the needs of the user.

Further, sometimes the length of the minor plunger causes flexion. This is detrimental for the operation of the invention because it causes wear of the watertight element provided at the lower end of the minor plunger, for example an O-ring. To solve this problem, a guide may be provided along the path of the minor plunger to prevent flexion from occurring.

Bushing: It is an essentially cylindrical bushing connected to a lower end of the pole such that the inner duct of the pole is in communication, making up an watertight internal chamber, with an actuation duct of the bushing. According to a preferred embodiment of the invention, the fluid in the watertight internal chamber is chosen between: water, glycol, glycerine and air.

In turn, through the longitudinal actuation duct of the bushing slides a major plunger whose diameter is larger than the diameter of the lower plunger. Further, the major plunger protrudes through the lower end of the bushing. The diameter difference between the minor and major plunger allows for the effort the user needs to make to displace the jacket, and therefore also the minor plunger, to be smaller with respect to the effort he/she would need to directly displace the major plunger. Furthermore, it allows for transforming the minor plunger stroke in a shorter major plunger stroke.

According to a preferred embodiment of the invention, the relationship between the transversal cross-section of the minor plunger and the transversal cross-section of the major plunger is approximately 1:10.

The major plunger is connected to a return device biasing it upwards such that, when no force is exerted on the jacket, the jacket adopts a retracted position near the grabbing end of the pole. In principle, the return device can be designed in different manners, although according to a particularly preferred embodiment of the invention the return device is a spring or elastic band connected to the major plunger.

Additionally, the lower end of the bushing comprises a flange radially protruding therefrom. For example, it can be an essentially circular horizontal flange.

On the other hand, sometimes it may be necessary to provide the bushing with a small conicity to allow for demoulding it in case it is made by injection moulding. In this case, according to a preferred embodiment of the invention, a variable thickness insert is added to cover the interior of the actuation duct of the bushing to recover its cylindrical form. This variable thickness insert can in principle be made of any suitable material for carrying out the disclosed function, such as for example a metal (aluminium, brass, etc.) or a plastic material. Thereby, by ensuring that the actuation duct is perfectly cylindrical, the watertightness of the major plunger is ensured. This further has the additional advantage of providing the plunger with a larger stroke.

Cams: They are two cams rotatably connected to the flange of the bushing at to diametrically opposite positions of said bushing. Thereto, each cam comprises a base rotatably connected to the flange and having an actuation shoulder, and two elongated arms protruding from the base.

Furthermore, thanks to said operation mode it is easy to replace the head of the mop, as disclosed in more detail further down in the present document.

b) Head

The head of the self-wringing mop can be coupled to a lower end of the major plunger. This coupling can be made in any manner allowing for uncoupling the head to be replaced when excessively worn out. For example, in a preferred embodiment of the invention, the lower end of the major plunger can comprise a hole configured for pressure coupling a protrusion provided at the upper surface of the head.

Further, in a particularly preferred embodiment of the invention, one between the protrusion of the head and the hole of the major plunger at least has a pair of pins or the like preventing, during use, rotation of the mop head with respect to the major plunger it is fixed to.

Furthermore, to ensure a firmer fixation between the protrusion of the head and the hole of the major plunger, the protrusion of the head preferably has pressure connectors to the hole of the major plunger to ensure a better fixation between both elements.

On the other hand, the head has an essentially circular shape from whose periphery a vertical wall protrudes, and in turn the upper edge of the vertical wall comprises an inner horizontal flange configured to engage the actuation shoulder of the cams when said cams are oriented with their arm in the vertical direction.

Additionally, the lower surface of the head comprises a plurality of absorbent strips. They are textile material strips similar to those used in any conventional mop.

In another preferred embodiment of the invention, the upper edge of the vertical wall of the head further has an exterior flange configured for preventing the absorbent strips from entering said head. In principle, the exterior flange may have any shape provided it can carry out the disclosed function, although preferably it is a horizontal or inclined flange having essentially a circular disc shape.

According to another preferred embodiment of the invention, the bottom of the head comprises at least a water evacuation hole for preventing water from accumulating inside the head. For example, a plurality of small wringing holes through which water entering inside the head can escape can be provided.

c) Bucket

The bucket is similar to those conventionally employed, although with the particular characteristic of comprising a cylindrical or conical wringer having an upper inwardly protruding flange. This upper flange can be made as a single body with the wringer, or alternatively a separate annular part can be coupled, for example by pressure or adhesive means, to the upper flange of the wringer.

Thanks to this configuration, when the head is coupled to the main body, the resulting self-winging mop can alternate between essentially two positions:

Rest position

In the rest position, the major plunger is in a retracted position, such that the head connected to said major plunger is also in a retracted position. In this position, the inner horizontal flange of the head is engaged to the actuation shoulder of the cams causing them, in turn, to be oriented with its elongated arm in an essentially vertical direction.

Wringing position

In the wringing position, a downward displacement of the cylindrical jacket along the pole by a user causes the minor plunger to push a fluid present in the watertight inner chamber. The fluid, in turn, pushes the major plunger downwards which, in turn, causes a downward displacement of the head coupled thereto. Therefore, the inner horizontal flange actuates the actuation shoulder to cause the cams to turn until the elongated arms are in an inclined position. In this inclined position, when the head is inside the wringer, the elongated arms can be coupled to the upper flange present in the upper edge of the wringer. An additional downward displacement of the jacket causes the major plunger to keep moving and to compress the set of strips against the wringer.

Therefore, this system reduces the effort made by the user to compress the strips of the mop, since he/she needs only to introduce the head of the mop in the wringer and, thereafter, to displace the jacket downwards. The diameter difference between the minor plunger and the major plunger, as well as the coupling mechanism between the mop bushing and the wringer flange, make the compression force applied on the strips to be larger than the force applied by the user.

This application shows an important difference with respect to prior art patent ES2303391 in connection with the manner in which the cams are opened. In document ES2303391, the opening of the cams takes place thanks to the contact of the major plunger against protrusions present in said cams taking place during the forward displacement of said major plunger. This operation mode had a number of drawbacks, all of which are solved by means of the cam opening mechanism disclosed in this document.

In an alternative embodiment, the head could lack an inner horizontal flange and the cams may lack an actuation shoulder. In that case, when the mop of the invention is in the rest position disclosed later on in this document, the vertical wall of the head surrounds the base portion of the cams, thus maintaining the in vertical position. When the mop moves to the wringing position, the vertical wall of the head ceases to surround the base portion of the cams which, at that moment, rotate, moving to the open position by the effect of gravity.

Further, according to a particularly preferred embodiment of the invention, the inner duct of the pole is divided into a central duct having a circular shape and a peripheral duct having a cylindrical shape, where the central duct is in communication with the actuation duct of the bushing. The peripheral duct can be closed at its lower end or, alternatively, it can be open in communication with the actuation duct of the bushing. The central duct is in communication with the peripheral duct by means of an slotted hole, that is, an essentially rectangular hole made in an lower portion of said central duct. Correspondingly, the minor plunger is divided into a central plunger having a circular cross-section that slides along the central duct, and a peripheral plunger having a cylindrical cross-section that slides along the peripheral duct. Thus, all the fluid displaced by the peripheral plunger enters the central duct through the slotted hole, further increasing the pressure in the watertight inner chamber of the bushing. That is, in this configuration the force transmitted by the minor plunger to the major plunger increases because the effective cross-section of the main body of the self-wringing mop increases. Therefore, the effort made by the user to wring the mop is reduced, and further a shorter jacket stroke is obtained because a larger amount of fluid is displaced.

On the other hand, the use of lubricants is generally known, normally lubricant oil, to ease the sliding movement of plungers and the like. However, in the present invention, liquid vaseline is preferably used as a lubricant to ease the displacement of the minor and major plungers.

A second aspect of the present invention is also directed to a self-wringing mop main body as disclosed above.

A third aspect of the present invention is also directed to a self-wringing mop head as disclosed above.

A fourth aspect of the present invention is also directed to a self-wringing mop bucket as disclosed above.

PREFERRED EMBODIMENT OF THE INVENTION

Now a particular example of a self-wringing mop system according to the invention is disclosed with reference to the attached drawings.

Figure 1A:
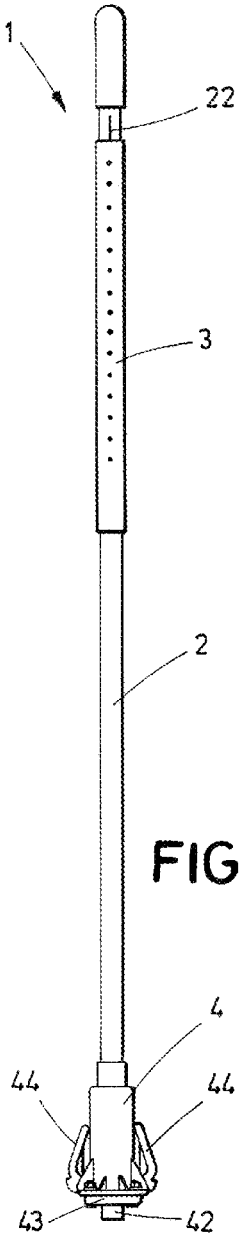
FIGS. 1*a*, 1*b y* 1*c* show the main body of the self-wringing mop of the present invention respectively in the rest position and in the wringing position, and a detail of the jacket with the minor plunger connected thereto.
Figure 1B:
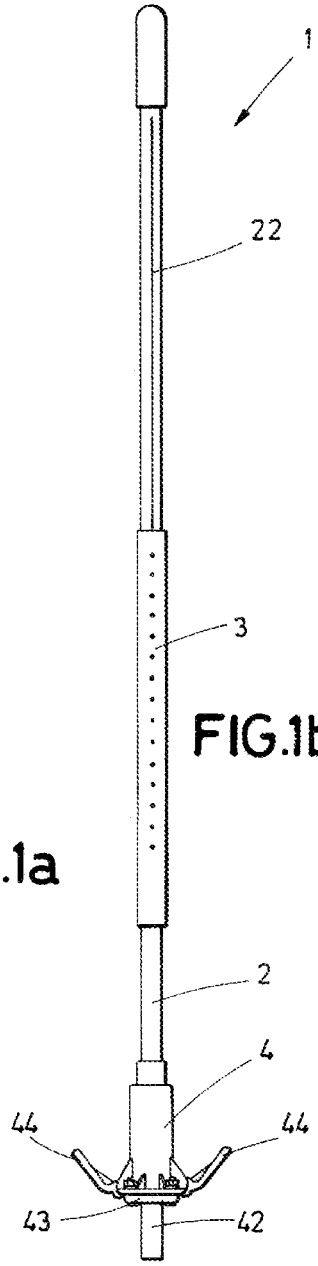
Figure 1C:
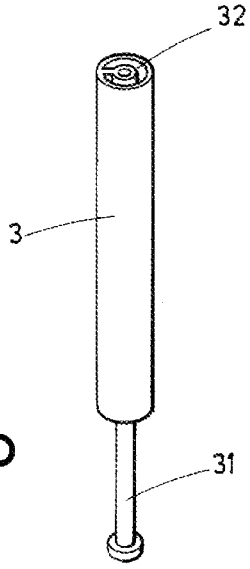

FIGS. 1*a* and 1*b* show the main body (1) of the self-wringing mop comprising an elongated pole (2) along which a cylindrical jacket (3) longitudinally slides. The cylindrical jacket (3) is connected to a minor plunger (31) housed in a watertight manner in an inner duct (21) of the pole, such that when a user holds the cylindrical jacket (3) and displaces it from its retracted position, closest to the holding end of the pole (2), to its advanced position, closest to the end of the pole (2) where the head (6) is located, causes the forwards displacement of the minor plunger (31). The connection between the cylindrical jacket (3) and the minor plunger (31) is implemented by means of a radial rib (32) sliding along a longitudinal slot (22) of the pole (2) when the cylindrical jacket (3) is displaced longitudinally along said pole (2). This configuration is shown in further detail in FIG. 1*c*, where the radial rib (32) connecting the cylindrical jacket (3) and the minor plunger (31) is shown.

Figure 7A:
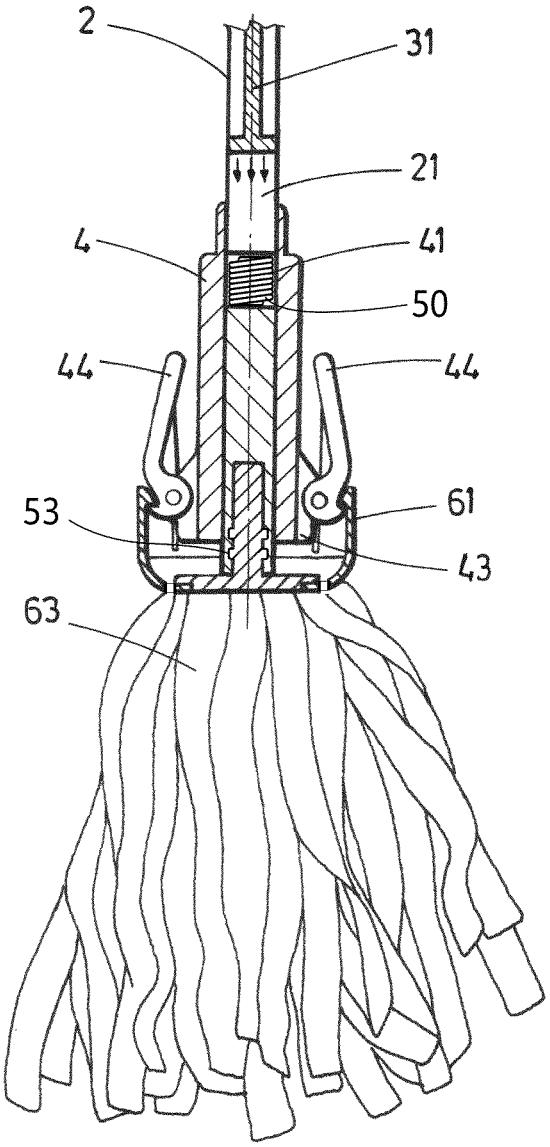
FIGS. 7*a* and 7*b* show a longitudinal section of the self-wringing mop respectively in the rest position and in the wringing position.
Figure 7B:
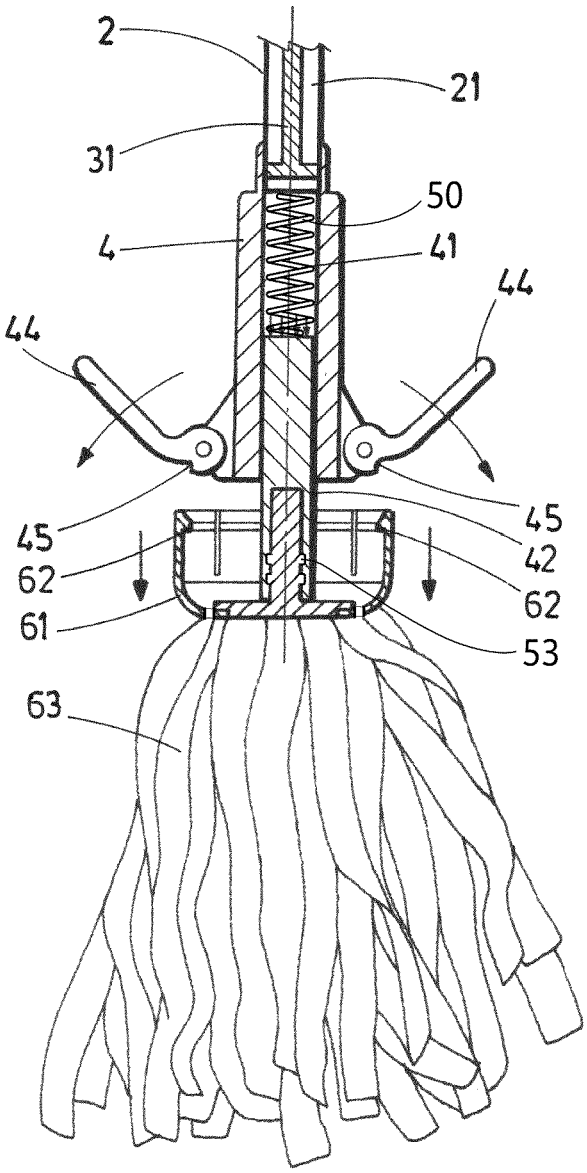

The lower end of the pole (2) is coupled to an essentially cylindrical bushing (4) and has an inner cylindrical actuation duct (41) whose cross-section is considerably larger than the cross section of the inner duct (21). For example, the cross-section ratio may be of 10:1. As shown in FIGS. 7*a* and 7*b*, the inner duct (21) of the pole (2) opens in the actuation duct (41) of the bushing (4), such that both in combination make up a pressure chamber. A major plunger (42) is housed in a watertight manner inside the inner duct (21) such that it can slide downwards therethrough when the user causes the cylindrical jacket (3) to move downwards. Furthermore, a return device, for example a spring 50, is coupled to the major plunger (42) and to the inside of the pressure chamber such that a constant force exerted on said major plunger (42) tends to move it to the retracted position. Therefore, when the user does not exert force on the cylindrical jacket (3), the spring causes both the major plunger (42) and the minor plunger (31), and therefore also the cylindrical jacket (3), to move to their respective retracted positions.

The lower end of the bushing (4) has an essentially circular flange (43) to which two cams (44) are connected in diametrically opposite positions, where each cam (44) has an elongated shape comprising a base 51 fixed to the flange (43) and a free arm. The connection between the base 51 of each cam (44) and the flange (43) is rotatable along an axis that is essentially tangent to the flange (43), such that the rotation of the cam causes the corresponding arm to move upwards or downwards. Furthermore, the base of each cam (44) has an essentially planar shoulder o rib (45) that protrudes horizontally outwards from the base of the cam (44) when said cam is vertically oriented.

Figure 2A:
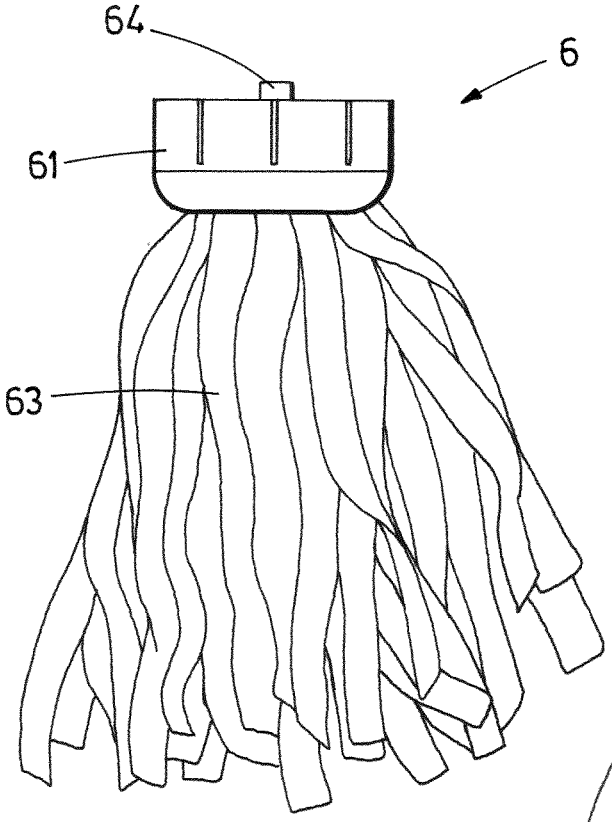
FIG. 2*a y* 2*b* respectively show a view and a section of the self-wringing mop head according to the present invention.
Figure 2B:
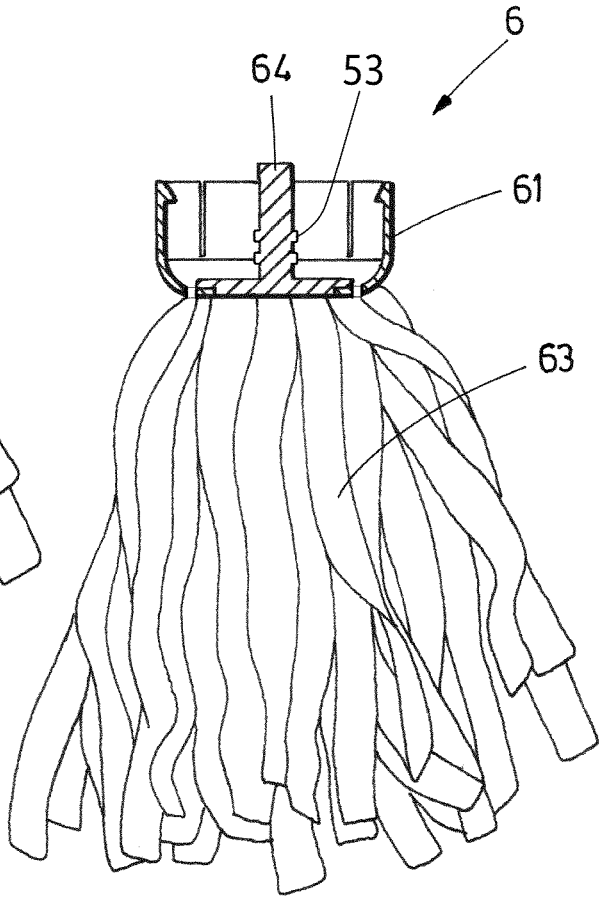

FIGS. 2*a* and 2*b* respectively show a lateral view and a longitudinal view of a self-wringing mop head (6) according to the present invention. As shown, the head (6) has an essentially circular plan shape and has a vertical wall (61). In turn, the upper edge of the vertical wall (61) has a horizontal flange (62) inwardly protruding from said wall (61). The head (6) also has a protrusion (62) protruding at the centre of its upper surface, and designed to engage to a corresponding cavity provided at the lower end surface of the major plunger (4). The coupling between both parts can be carried out, for example, by pressure, threading, or generally speaking any manner allowing for the head (6) to be selectively coupled and uncoupled to the main body (1) of the self-wringing mop.

The dimensions of the head (6) and the bushing (4) are designed such that, when it is coupled to the major plunger (42) and the major plunger (42) is in the retracted position, the horizontal flange (62) is coupled to the shoulder (45) of the bushing (4) such that the arms of the cams (44) are in a vertical position. When the major plunger (42) is displaced downwards, the lowering of the flange (62) of the head (6) causes a downward vertical force on the shoulder (45) causing the cam (44) to rotate outwards, such that the arms of the cam (44) open for moving from the original vertical position to an inclined position with respect to the longitudinal axis of the self-wringing mop.

Additionally, as is common in any head of a conventional mop, the head (6) of the invention has a set of strips (63) fixed to its lower surface. The set of strips (63) is formed by a plurality of strips made of an absorbent textile material.

Figure 3:
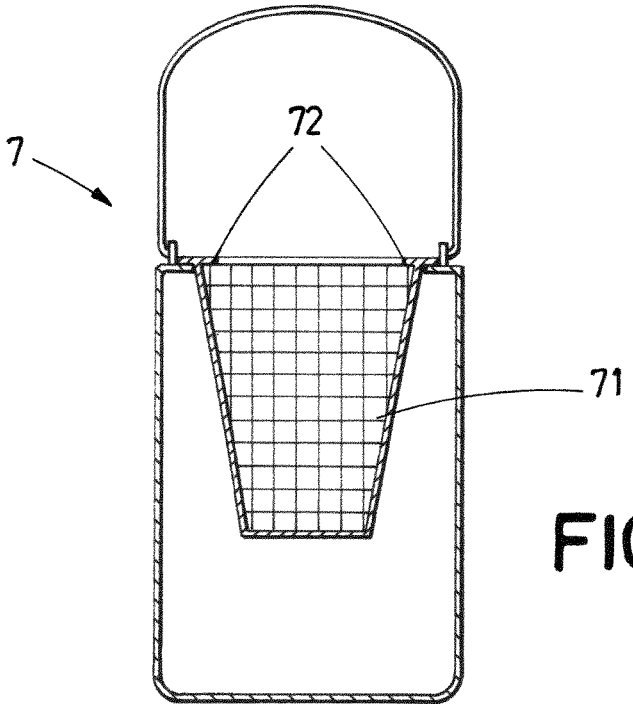
FIG. 3 shows a view of a bucket having a self-wringing mop wringer according to the present invention.

FIG. 3 shows a cross section of a bucket (7) having a wringer (71) that is particularly designed to be used with the self-wringing mop disclosed. Particularly, the wringer (71) is coupled to the upper edge of the bucket (7) and has an essentially conical shape tapering downwards. A particular feature of this wringer (71) is having a horizontal flange (72) protruding inwards from its upper edge.

Figure 4A:
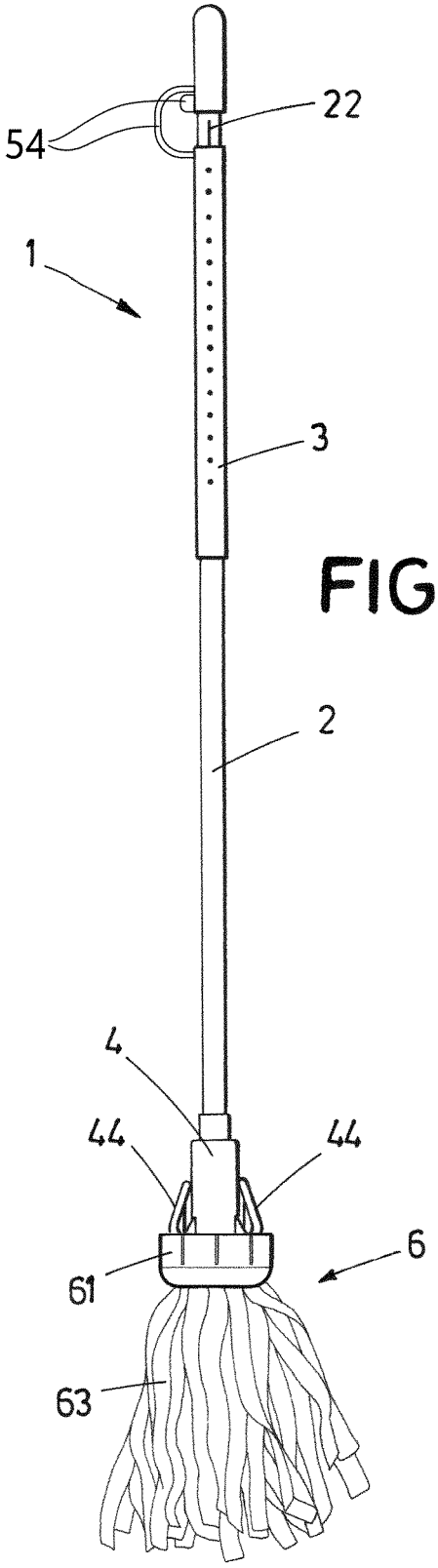
FIGS. 4*a* and 4*b* show a self-wringing mop formed by the main body coupled to the head respectively in the rest and wringing position.
Figure 4B:
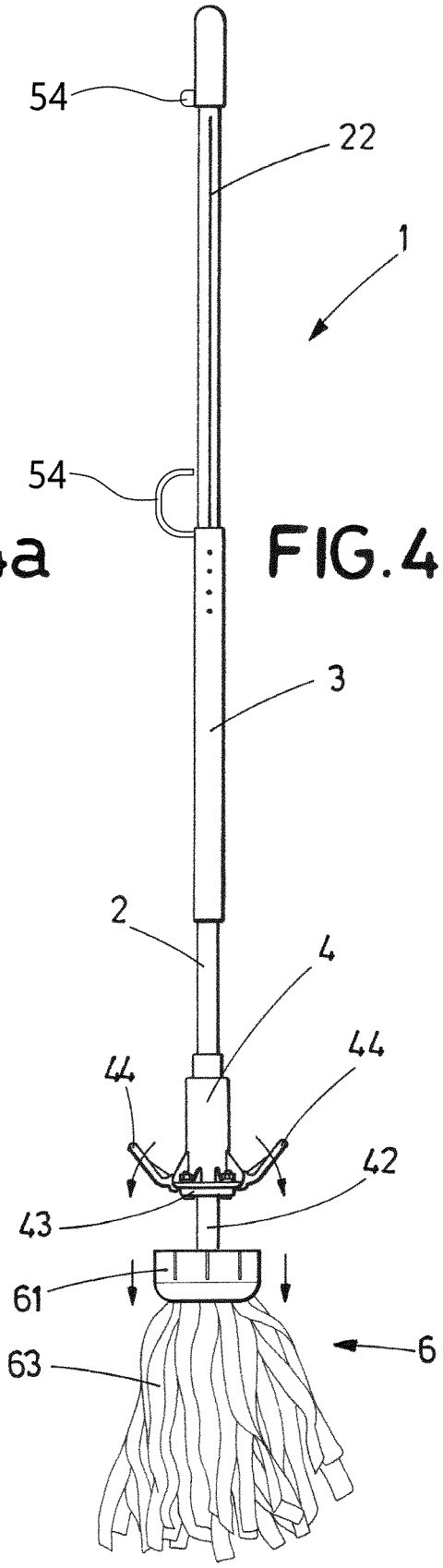
Figure 5C:
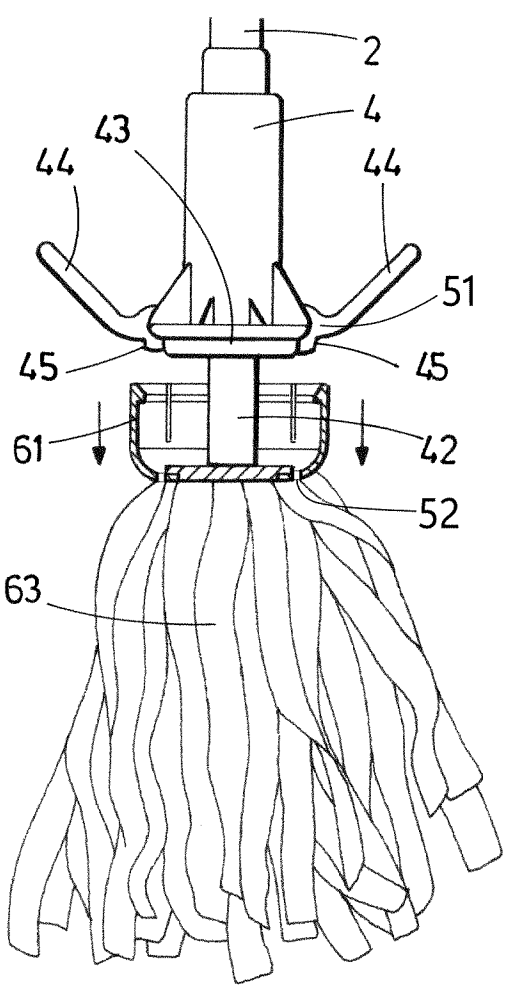
FIGS. 5*a*-5*c* show in more detail the interaction between the bushing of the main body and the head while moving from the rest position to the wringing position.
Figure 5B:
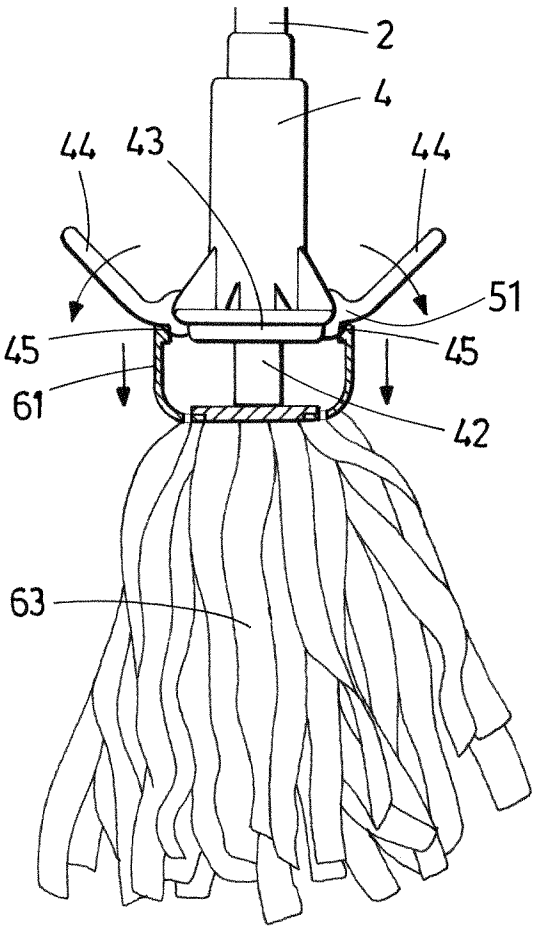
Figure 5A:
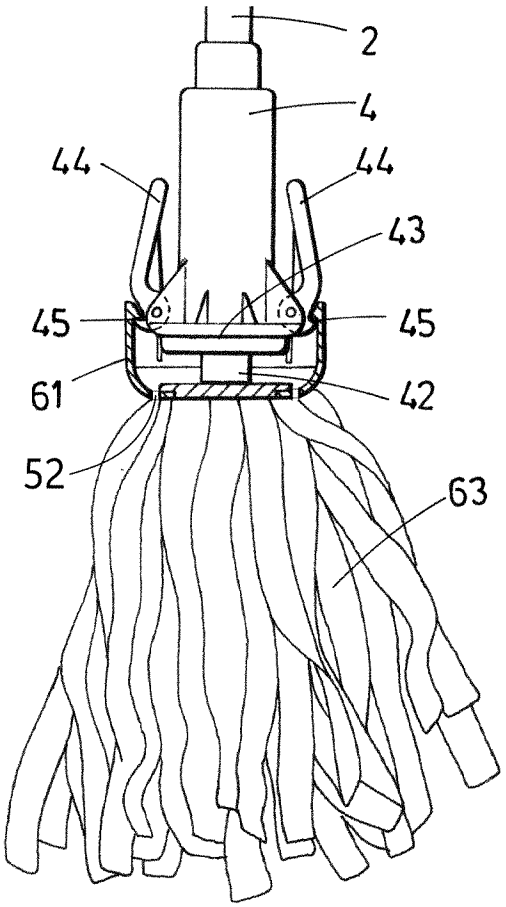

FIGS. 4*a* and 4*b* show in a simplified manner the operation of the self-wringing mop according to the present invention. In an initial rest position, the cylindrical jacket (3) is in the retracted position, thus causing also the major plunger (42) and the head (6) to be in the retracted position. The shoulders (45) of the cams (44) are coupled to the flange (62) of the vertical wall (61) of the head (6), and therefore the arms of the cams (44) are in the vertical position. When the user actuates the cylindrical jacket (3) by displacing it downwards along the pole (2) of the main body (1) of the self-wringing mop, the corresponding lowering of the minor plunger (31) causes the pressure within the watertight pressure chamber to raise and, therefore, the lowering of the major plunger (42) along the actuation duct (41) is also caused. The head (6), coupled to the lower end of the major plunger (42), is displaced downwards with respect to the bushing (4) and, during said displacement, the interaction between the flange (62) of the head (6) and the shoulders (45) of the cams (44) causes the cams (44) to rotate outwardly. Therefore, the arms of the cams (44) are caused to move from the vertical position to an inclined position. This process is shown in more detail in FIGS. 5*a*-5*c* and in FIGS. 7*a*-7*b*. This mechanism is different to that disclosed in prior art patent ES2303391, where the major plunger caused the cams to open.

This configuration has an additional advantage consisting of making the operation of disassembling the head (6) from the lower end of the major plunger (42) easy. Indeed, if starting from the position shown in FIG. 7 where the major plunger (42) is in the upper position, the user pulls manually from the arms of the cams (44) downwardly, the rotation of the cams (44) causes the respective shoulders (45) to exert a downward vertical force on the vertical wall (61) of the head. This force extracts the protrusion (64) from the corresponding cavity of the major plunger (42), such that the head (6) separates from said major plunger (42).

Figure 6A:
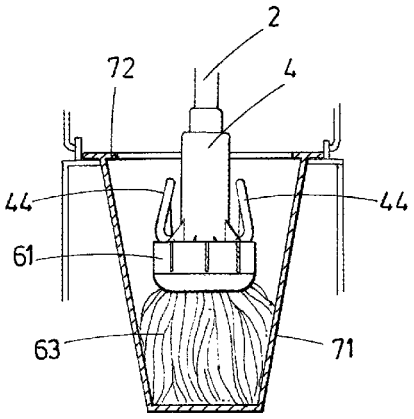
FIGS. 6*a*-6*c* schematically show the user of the self-wringing mop according to the present invention.
Figure 6B:
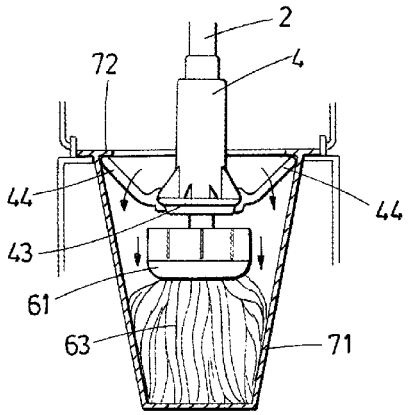
Figure 6C:
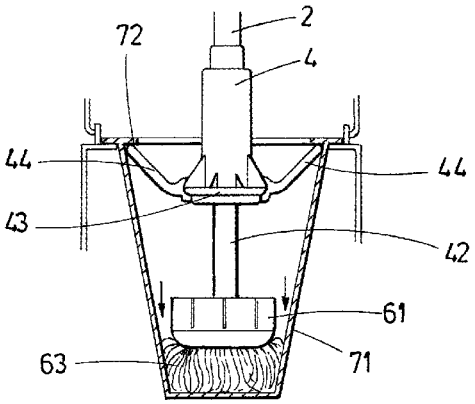

FIGS. 6*a*-6*c* show how the self-wringing mop formed by the combination of the main body (1) and the head (6), by operating in the manner disclosed in the paragraph above, makes the wringing operation easier for the user. In the first place, with the self-wringing mop in the rest position, the user uses the mop in the conventional manner to absorb a liquid present on the floor. Then, as shown in FIG. 6*a*, the user introduced the lower end of the main body (1) where the head (6) is fixed to the wringer (71). Once inside, the user manually causes the cylindrical jacket (3) to move downwards. This downward movement causes the major plunger (42), and correspondingly the head fixed thereto, to move downwardly. This displacement, as disclosed above, causes the cams (44) to rotate outwardly. When the arms of the cams (44) open, they engage or abut against the horizontal flange (72) of the wringer (71), such that the bushing (4) as a whole abuts against said horizontal flange (72). If the user keeps moving the cylindrical jacket (3) downwardly, the major plunger (42) also moves downwardly and makes the set of strips (63) protruding downwardly from the head (6) to be compressed against the bottom of the wringer (71). The compression does not require the application of a great force by the user, since the bushing (4) firmly abuts against the flange (72) of the wringer (71).

Figure 8:
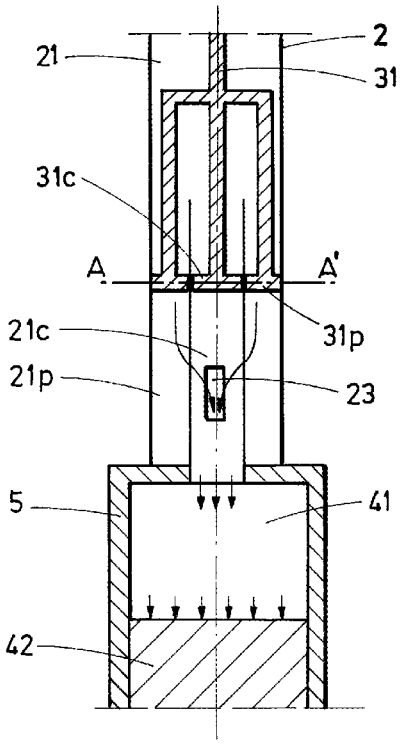
FIG. 8 shows a detailed view of the main body of the self-wringing mop where the inner duct of the pole is divided in two.
Figure 9:
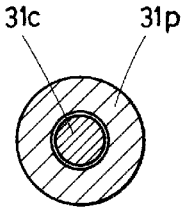
FIG. 9 shows a transversal cross section of the minor plunger of the mop shown in FIG. 8.

FIG. 8 shows a particularly preferred embodiment of the pole (2) where the minor plunger (31) is divided into a central plunger (31*c*) having a circular cross-section and a peripheral plunger (31*p*) having a cylindrical cross-section. FIG. 9 shows a cross-section of the plunger (31) where the shape of the central plunger (31*c*) and the peripheral plunger (31*p*) are more clearly illustrated. Correspondingly, the inner duct (21) of the pole is divided into a central duct (21*c*) having a circular shape through which the central plunger (31*c*) slides and a peripheral duct (21*p*) having a cylindrical shape through which the peripheral plunger (31*p*) slides. The peripheral duct (21*p*) is closed at the lower end, and it is in communication with the central duct (21*c*) through a slotted hole (23) or rectangular orifice made in a lower portion of the wall making up the central duct (21*c*). Therefore, when the minor plunger (31) is displaced longitudinally downwards, it moves fluid both along the central duct (21*c*) and the peripheral (21*p*) duct. The fluid displaced along the peripheral duct (21*p*) enters the final portion of the central duct (21*c*) through the slotted hole (23), thereby further increasing the pressure increment generated in the actuation duct (41). The force made by the user on the jacket (3) when carrying out a wringing operation is thereby reduced.

The invention claimed is:

1. A self-wringing mop system, comprising:

a) a self-wringing mop main body, comprising:

a pole having an inner duct;

a cylindrical jacket slidingly provided around the pole and connected to a minor plunger that slides in a watertight manner along the internal duct of said pole;

an essentially cylindrical bushing connected to a lower end of the pole such that the inner duct of the pole communicates, making up an actuation duct of the bushing through which a major plunger having a larger diameter than that of the minor plunger slides in a watertight manner, where the major plunger is connected to a return device that biases it upwards, where the major plunger protrudes through which the lower end of the bushing, and where the lower end of the bushing further comprises a flange radially protruding therefrom; and two cams rotatably connected to the flange of the bushing in diametrically opposed positions of said flange, where each cam comprises an actuation shoulder rotatably connected to the flange, and an elongated arm protruding from the actuation shoulder, b) a self-wringing mop head couplable to a lower end of the major plunger, where the head has an essentially circular shape from whose periphery a vertical wall protrudes, and where the upper edge of the vertical wall comprises an inner horizontal flange configured to engage the actuation shoulder of the cams when they are oriented with the elongated arm in the vertical direction, and where the lower surface of the head comprises a set of strips formed by a plurality of absorbent strips, and c) a bucket comprising a conical or cylindrical wringer having an upper flange protruding towards the inside, such that, when the head is coupled to the main body, the resulting self-wringing mop can alternate between:

a rest position where the major plunger is in a retracted position, such that the head connected to said major plunger is also in a retracted position where the inner horizontal flange is engaged to the actuation shoulder of the cams which, in turn, are oriented with their elongated arm in an essentially vertical direction; and a wringing position where a downward displacement of the cylindrical jacket along the pole by a user causes the minor plunger to push a fluid present inside the watertight internal chamber, which in turn pushes the major plunger downwards, which in turn causes a downward displacement of the head coupled thereto such that the inner horizontal flange actuates the actuation shoulder to make the cams rotate until the elongated arms adopt an inclined direction, such that the elongated arms can couple to the upper flange present at the upper edge of the wringer and an additional downward displacement of the jacket causes the major plunger to descend further and compress the set of strips against the wringer, comprising:

the inner duct of the pole is divided into a central duct having a circular shape and a peripheral duct having a cylindrical shape, where the central duct is in communication with the actuation duct of the bushing, where the central duct is in communication with the peripheral duct through a slotted hole provided at a lower portion of said central duct, and where the minor plunger is correspondingly divided into a central plunger having a circular cross-section sliding along the central duct, and a peripheral plunger having a cylindrical cross-section sliding along the peripheral duct.

2. The self-wringing mop system according to claim 1 which, in case the actuation duct of the bushing has a slight conicity to make unmolding easier, further comprises a variable thickness insert lining the inside of the actuation duct to recover its cylindrical form.

3. The self-wringing mop system according to claim 1, where the upper edge of the vertical wall of the head further comprises an external horizontal flange preventing the absorbent strips from the set of strips to enter inside said head.

4. The self-wringing mop system according to claim 1, where a bottom of the head comprises at least a water evacuation hole to prevent water from accumulating inside the head.

5. The self-wringing mop system according to claim 1, where the ratio between the minor plunger cross-section and the major plunger cross-section is approximately 1:10.

6. The self-wringing mop system according to claim 1, where the fluid in the watertight internal chamber is chosen between: water, glycol, glycerine and air.

7. The self-wringing mop system according to claim 1, where the return device is an elastic band or a spring connected to the major plunger.

8. The self-wringing mop system according to claim 1, where the lower end of the major plunger comprises a hole configured for pressure engagement with a protrusion provided at the upper surface of the head.

9. The self-wringing mop system according to claim 8, where one between the protrusion of the head and the hole of the major plunger has at least a pair of pins or the like preventing, during use, the head of the mop from rotating with respect to the major plunger it is fixed to.

10. The self-wringing mop system according to claim 8, where the protrusion of the head has pressure fittings (53) to the hole of the major plunger to ensure a more secure fixation between both elements.

11. The self-wringing mop system according to claim 1, where the inner duct of the pole is divided into a central duct having a circular shape and a peripheral duct having a cylindrical shape, where the minor plunger is correspondingly divided into a central plunger having a circular cross-section sliding along the central duct, and a peripheral plunger having a cylindrical cross-section sliding along the peripheral duct.

12. The self-wringing mop system according to claim 1, further comprising a latch allowing the user to selectively lock the cylindrical jacket in its retracted position.

13. The self-wringing mop system according to claim 1, where liquid vaseline is used as a lubricant to ease the displacement of the minor and major plungers.

14. A main body of a self-wringing mop, comprising: —a pole having an inner duct; —a cylindrical jacket slidingly provided around the pole and connected to a minor plunger that slides in a watertight manner along the internal duct of said pole; —an essentially cylindrical bushing connected to a lower end of the pole such that the inner duct of the pole communicates, making up an actuation duct of the bushing through which a major plunger having a larger diameter than that of the minor plunger slides in a watertight manner, where the major plunger is connected to a return device that biases it upwards, where the major plunger protrudes through which the lower end of the bushing, and where the lower end of the bushing further comprises a flange radially protruding therefrom; and —two cams rotatably connected to the flange of the bushing in diametrically opposed positions of said flange, where each cam comprises and an actuation shoulder rotatably connected to the flange, and an elongated arm protruding from the actuation shoulder, comprising: the inner duct of the pole is divided into a central duct having a circular shape and a peripheral duct having a cylindrical shape, where the central duct is in communication with the actuation duct of the bushing, where the central duct is in communication with the peripheral duct through a slotted hole provided at a lower portion of said central duct, and where the minor plunger is correspondingly divided into a central plunger having a circular cross-section sliding along the central duct, and a peripheral plunger having a cylindrical cross-section sliding along the peripheral duct.

15. The self-wringing mop main body according to claim 14 which, in case the actuation duct of the bushing has a slight conicity to make unmoulding easier, further comprises a variable thickness insert lining the inside of the actuation duct to recover its cylindrical form.

16. The self-wringing mop main body according to claim 15, where the ratio between the minor plunger cross-section and the major plunger cross-section is approximately 1:10.

17. The self-wringing mop main body according to claim 16, where the fluid inside the watertight inner chamber is chosen between: water, glycol, glycerine and air.

18. The self-wringing mop main body according to claim 17, where the return device is an elastic band or a spring connected to the major plunger.

19. The Self-wringing mop main body according to claim 18, where the lower end of the major plunger comprises a hole configured for pressure coupling a protrusion provided at the upper surface of the head.

20. The self-wringing mop main body according to claim 19, further comprising a latch allowing the user to selectively lock the cylindrical jacket in its retracted position.

21. The self-wringing mop head couplable to the lower end of the major plunger of the main body according to claim 14, where the head has an essentially circular shape from whose periphery a vertical wall protrudes, and where the upper edge of the vertical wall comprises an inner horizontal flange configured to engage the actuation shoulder of the cams when they are oriented with their arm in the vertical direction, and where the lower surface of the head comprises a set of strips formed by a plurality of absorbent strips, such that, when the head is coupled to the main body, the resulting self-wringing mop can alternate between:

a rest position where the major plunger is in a retracted position, such that the head connected to said major plunger is also in a retracted position where the inner horizontal flange is engaged to the actuation shoulder of the cams which, in turn, are oriented with their elongated arm in an essentially vertical direction; and a wringing position where a downward displacement of the cylindrical jacket along the pole by a user causes the minor plunger to push a fluid present inside the watertight internal chamber, which in turn pushes the major plunger downwards, which in turn causes a downward displacement of the head coupled thereto such that the inner horizontal flange actuates the actuation shoulder to make the cams rotate until the elongated arms adopt an inclined direction, such that the elongated arms can couple to the upper flange present at the upper edge of the wringer and an additional downward displacement of the jacket causes the major plunger to descend further and compress the set of strips against the wringer.

22. The self-wringing mop head according to claim 21, where the upper edge of the vertical wall further comprises an external horizontal flange preventing the absorbent strips of the set of strips from entering inside said head.

23. The self-wringing mop head according to claim 22, where a bottom of the head comprises at least a water evacuation hole for preventing water from accumulating inside the head.

* * * * *